United States Patent [19]

Tuyet-Van

[11] Patent Number: 4,514,863

[45] Date of Patent: May 7, 1985

[54] SOCK

[76] Inventor: Hoang T. Tuyet-Van, 1921 Beloit Ave., Los Angeles, Calif. 90025

[21] Appl. No.: 417,460

[22] Filed: Sep. 13, 1982

[51] Int. Cl.[3] ..... A41B 11/00

[52] U.S. Cl. ..... 2/240

[58] Field of Search ..... 2/240, 239, 241, 335, 2/253, 256

[56] References Cited

U.S. PATENT DOCUMENTS

| | | | |
|---|---|---|---|
| 1,806,963 | 5/1931 | Woods | 2/240 |
| 1,813,266 | 7/1931 | Woods | 2/240 X |
| 1,827,343 | 10/1931 | Woods | 2/240 |
| 2,034,897 | 3/1936 | Crane | 2/240 |
| 2,283,278 | 5/1942 | Morse | 2/240 |

*Primary Examiner*—Ronald Feldbaum

*Attorney, Agent, or Firm*—Freilich, Hornbaker, Rosen & Fernandez

[57] ABSTRACT

A sock is described which can be worn in a boot or other situation where an ordinary sock is likely to sag, wherein the sock is constructed to resist such sagging. The sock includes an elastic sock body and a strip-shaped stiffener sewn to the outer surface of the sock body. The stiffener extends along the front of the sock body on the upper sock portion which surrounds the leg of the wearer, and on the lower sock portion that surrounds the foot of the wearer. The stiffener extends in a loop above the top of the sock body to form a finger-receiving loop that can be used to pull up the sock.

9 Claims, 5 Drawing Figures

FIG. 1
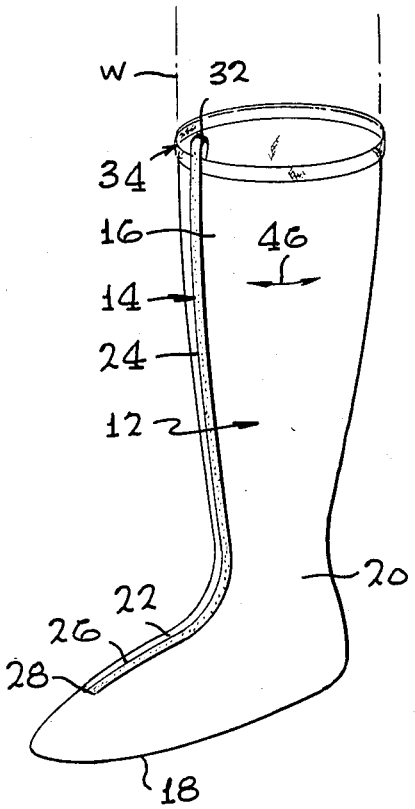
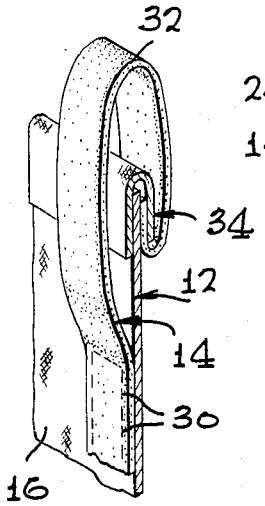
FIG. 2
FIG. 4
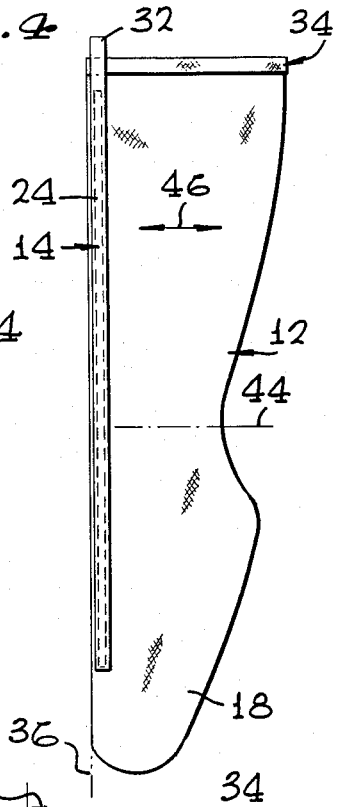
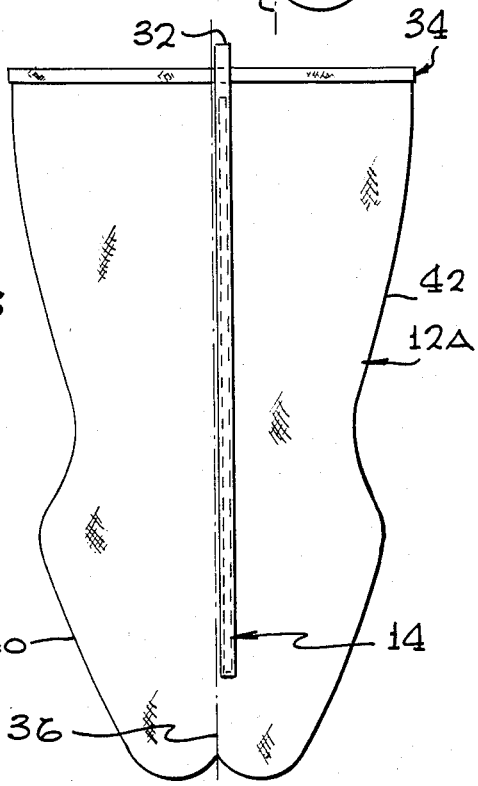
FIG. 5
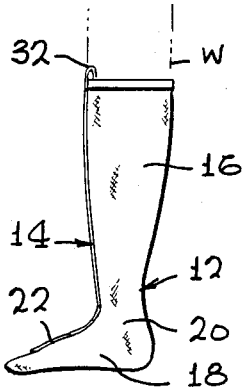
FIG. 3

SOCK

BACKGROUND OF THE INVENTION

Socks tend to sag along the upper portion that surrounds the lower leg of the wearer so that folds develop just above the ankle. Also, socks that are worn in a loose fitting boot tend to sag along the incline at the top of the wearer's foot. Various types of stiffeners have been proposed for use with socks, but they have not worked well in practice. A stiffening arrangement for a sock which enabled construction at low cost and which was effective in resisting sagging, could be of considerable benefit.

SUMMARY OF THE INVENTION

In accordance with one embodiment of the present invention, a sock is provided which is effective in resisting sagging. The sock includes a sock body and a strip-shaped stiffener. An upper portion of the stiffener lies at the front of the upper sock body portion (which surrounds the lower leg of the wearer), and a lower portion of the stiffener lies at the top of the lower sock body portion (which surrounds the foot of the wearer). The stiffener resists sagging that would otherwise create folds near the ankel, and also resist sagging that would create folds along the top of the foot of the wearer.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a sock constructed in accordance with the present invention, showing how it is worn.

FIG. 2 is a partial sectional view of the sock of FIG. 1, showing details of the construction thereof.

FIG. 3 is a side elevation view of the sock of FIG. 1.

FIG. 4 is a plan view of the sock of FIG. 1, showing it in a stored position.

FIG. 5 is a plan view of the sock of FIG. 4, shown during construction thereof.

DESCRIPTION OF THE PREFERRED EMBODIMENT

FIG. 1 illustrates a sock 10 of the present invention, which includes a sock body 12 and a stiffener 14. The sock body includes an upper portion 16 that surrounds the lower leg of a wearer W, and a lower portion 18 that surrounds the foot of the wearer. In the absence of the stiffener, the sock tends to sag so as to create multiple folds at the ankle 20. In addition, where the lower sock portion 18 is worn in a loose-fitting boot or without any boot or shoe support, sagging tends to occur at the location 22 at the top of the wearer's foot where the sock extends at a moderate incline from the horizontal. The stiffener 14 is designed to resist both types of sagging.

The stiffener 14 extends almost the entire height of the sock, with an upper stiffener portion 24 attached to the upper sock body portion 16 to lie at substantially the middle of the front of the sock thereat, and with a lower stiffener portion 26 attached to the lower sock body portion 18 to lie at substantially the middle of the top of the sock thereat. The extreme lower end 28 of the stiffener lies a couple of inches behind the toes of the wearer.

As shown in FIG. 2, the stiffener 14 includes a strip of flexible but substantially inelastic material such as a strip of soft vinyl plastic material of a thickness of 0.5 mm and a width of 10 mm, or in other words with a width more than 10 times as great as its thickness. The strip is attached substantially all along its length to the sock body 12, as by sewing it at the stitches 30 to the outside surface of the sock body. The top of the stiffener extends in a loop 32 over the top of the sock body and with both ends of the loop tied to the sock body. The loop 32, which is free of attachment to the sock body, is large enough to receive a finger of the wearer. To pull up the sock, the wearer inserts her finger through the free loop 32 and pulls upwardly. A strip-shaped binding 34 extends around the top of the main body part, by folding the binding to lie over the front and rear sock body surfaces. The binding 34, which is made of the same material as the sock body, helps prevent the rear of the sock from sagging, by supporting it on the front. An end of the loop extends down along the inside of the binding, and then up along the inner surface of the body 12 to lie sandwiched between the inner surface of the body and the binding.

The sock is formed by first cutting the body in the shape shown at 12A in FIG. 5, wherein the cut piece is symmetrical about a longitudinal line 36. The stiffener 14 and binding 34 are then sewn in place. The cut body is then folded over its longitudinal line 36, and its opposite edges 40, 42 are sewn together. The sewing is accomplished with the body folded so the stiffener 14 lies on the inside of the body. After the edges are sewn together the sock is turned inside out. The edges at 40, 42 form the rearward edge of the sock, while the longitudinal line 36 extends along the middle of the front of the sock.

The stiffener 14 is sewn immediately to one side of the longitudinal line 36, so the sock does not have to be folded along the stiffener. Prior to use, the sock can lie flat as shown in FIG. 4, since the body 12 is a single sheet of material that has been folded once along the line 36. More compact folding can be accomplished by folding the sock, shown in FIG. 4, along a transverse line as at 44. The material of the sock body 12 is a stretchable material that easily stretches by at least 30% in a lateral direction as shown by arrow 46, but which does not happen to stretch in a perpendicular direction parallel to the line 36. The stretchable sock body enables the sock to be stretched to fit onto a person's foot so the upper portion 24 of the stiffener is not initially bent and therefore better resists sagging. It is noted that the sock may produce a couple of folds near the ankle when placed on a foot wherein the bottom portion 18 of the sock body must be turned 90°, but multiple folds are not formed that come together to form a sagging area.

Thus, the invention provides a sock which can be constructed at relatively low cost and which is effective in avoiding sagging both along the upper or leg portion of the sock body where it encloses the lower leg of the wearer and also along the top of the lower or foot portion of the sock body where it lies on the foot of the wearer. The sock includes a strip-shaped stiffener attached to the sock body, with an upper stiffener portion lying on the leg portion of the sock body along the front thereof. The stiffener also includes a lower portion which extends most of the distance from the ankle to the toes of the wearer's foot. The sock body can be cut from a single sheet of stretchable material that has been folded over along a longitudinal line and the stiffener can be attached to the body to lie beside but not directly on the longitudinal fold line. The stiffener can include a free loop at the top of the sock, for receiving a finger of the wearer to enable the wearer to pull up the sock.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A sock comprising:

a sock body which includes a lower portion for surrounding the foot of a wearer and an upper portion for surrounding the lower leg of the wearer; and a strip-shaped stiffener having an upper stiffener portion attached to said upper sock body portion, and having a lower stiffener portion attached to the lower sock body portion, said lower stiffener portion positioned to lie on the top of the foot of a wearer and extend from the ankle and along most of the distance therefrom to the toes of the wearer's foot.

2. The sock described in claim 1 wherein:

said strip-shaped stiffener is fastened to the outside surface of the sock along most of its length, and has an upper end which extends in a loop over the top of the sock body and is fastened to another surface of the sock body, said loop having a free loop portion which is long enough to allow reception of a finger therein, whereby to enable a person to pull up a sock by pulling on the stiffener.

3. The sock described in claim 2 wherein:

said sock includes a binding which extends around the top of the sock body, said binding folded over to lie over the front and rear surfaces of the sock body, and the upper end of the stiffener extends from the outer surface of the sock body, upwardly, and in a loop and down to the inner surface of the sock body and then upwardly to lie sandwiched between the inner surface of the sock body and the binding.

4. The sock described in claim 1 wherein:

said sock body includes a sheet of material which is symmetrical about an imaginary longitudinal line which extends along the front of the wearer's leg and the top of the foot and which can lie flat, and which can stretch substantially only in a predetermined lateral direction that is perpendicular to said longitudinal line, and which is folded over along said longitudinal line and with the edges opposite the longitudinal line sewn together; and said stiffener comprises a strip of flexible but substantially unstretchable material having a width more than 10 times its thickness and which is joined to said sock body to extend substantially along said longitudinal line.

5. The sock described in claim 4 wherein:

most of said stiffener lies beside said longitudinal line but not on said line.

6. A sock comprising:

a sock body that has a lower portion which can surround a foot of a wearer and an upper portion that can surround the lower leg of the wearer; and a strip-shaped stiffener attached to the outer surface of said sock body and extending substantially along the middle of the front of said upper sock body portion and substantially along the middle of the top of said lower sock body portion.

7. The sock described in claim 6 wherein:

said sock body is elastically stretcheable primarily in a direction perpendicular to the length of said stiffener, by more than 30%, and said stiffener comprises a strip of flexible but substantially unstretchable material having a width more than 10 times its thickness.

8. A sock comprising:

a sock body that has a lower portion which can surround a foot of a wearer and an upper portion that can surround the lower leg of the wearer; and a strip-shaped stiffener attached to the outer surface of said sock body and extending substantially along the middle of the front of said upper sock body portion and substantially along the middle of the top of said lower sock body portion;

said stiffener forming a finger-receiving loop at the top of said upper sock body portion.

9. A sock comprising:

a sock body that has a lower portion which can surround a foot of a wearer and an upper portion that can surround the lower leg of the wearer; and a strip-shaped stiffener attached to the outer surface of said sock body and extending substantially along the middle of the front of said upper sock body portion and substantially along the middle of the top of said lower sock body portion;

said stiffener lies beside the center of the front of the upper sock body portion and of the top of the lower sock body portion.

* * * * *